US008770776B1

(12) United States Patent
Yang

(10) Patent No.: US 8,770,776 B1
(45) Date of Patent: Jul. 8, 2014

(54) WATER LANTERN WITH FLASHING LIGHT

(71) Applicant: Chin-Sheng Yang, Tainan (TW)

(72) Inventor: Chin-Sheng Yang, Tainan (TW)

( * ) Notice: Subject to any disclaimer, the term of this patent is extended or adjusted under 35 U.S.C. 154(b) by 0 days.

(21) Appl. No.: 13/831,631

(22) Filed: Mar. 15, 2013

(51) Int. Cl.
*F21V 33/00* (2006.01)

(52) U.S. Cl.
USPC ..... 362/101; 362/96; 362/234; 362/253; 40/480; 40/541; 40/700; 40/714; 40/737

(58) Field of Classification Search
USPC ..... 362/101, 294, 500, 85; 40/406, 408, 40/541, 714, 700, 737
See application file for complete search history.

(56) References Cited

U.S. PATENT DOCUMENTS 7,430,823 B1 * 10/2008 Chung ..... 40/409
2003/0196357 A1 * 10/2003 Knapp et al. ..... 40/410
2006/0130377 A1 * 6/2006 Lin ..... 40/407
2009/0107869 A1 * 4/2009 Child et al. ..... 206/457
2012/0085675 A1 * 4/2012 Pedersen et al. ..... 206/525

* cited by examiner

*Primary Examiner* — Tracie Y Green
(74) *Attorney, Agent, or Firm* — Leong C. Lei

(57) ABSTRACT

The present invention provides a water lantern with flashing light which mainly comprises a water lantern body, a holder, and a graphics card unit. The water lantern body is provided above the holder. The water lantern body comprises a plane portion backward. The holder is provided with a slot backward corresponding to the plane portion. The bottom of the slot is provided with at least one flashing light-emitting element. The graphics card unit is inserted in the slot of the holder, and corresponding to the plane portion of the water lantern body. The graphics card unit obtains the light source from the light-emitting element from the bottom. Therefore, looking back from the front of the water lantern body, the patterns on the graphics card unit allows the water lantern body having enlarged brilliant effects visually.

4 Claims, 7 Drawing Sheets

WATER LANTERN WITH FLASHING LIGHT

TECHNICAL FIELD OF THE INVENTION

The present invention generally relates to a water lantern with flashing light, and more particularly to a water lantern design of visual decoration objects used in the environmental space, which allows the water lantern to generate brilliant visual effects using flashing patterns.

DESCRIPTION OF THE PRIOR ART

Generally, decorative accessories, such as picture frames, toys, jewelry, etc, are usually put on the desktop in daily life. These decorative accessories only have static functions of beautiful views. Therefore, there is a water lantern design with brightness chips, bright powders or decorations inside, which uses artificial inversely shake or allows the brightness chips, the bright powders or the decorations inside to generate the visual perception of the liquid flow using the power. Also, it has different visual effects due to various objects inside the water lantern, which allows it having a space for expansion, extending the effects of a various visual changes, or having versatility and interesting developments. Therefore, the water lantern design is a subject needed for the R&D of the environmental decorations to study.

In view of this, because the creators have engaged in the research of the decorations for many years, provide a decoration having brilliant visual effects, which is more beautiful and interesting. After continual trial and improvements, the present invention is provided.

SUMMARY OF THE INVENTION

The present invention provides a water lantern with flashing light, which mainly comprises:

a water lantern body, which is a translucent casing filled with liquidity liquid inside, and the water lantern body comprising a plane portion backward;

a holder, which comprises an opening upward, and the opening correspondingly connected with the water lantern body, at least one light-emitting element provided inside the holder and corresponding to the bottom of the water lantern body, and the holder provided with a slot backward, the bottom of the slot provided with at least one flashing light-emitting element; and a graphics card unit, which is inserted in the slot of the holder, and corresponding to the plane portion of the water lantern body from front to back comprising sequentially a translucent panel, a graphics card, and a backplane, the bottom of the translucent panel extending a protrusion used to obtain the light source from the light-emitting element, and the translucent panel provided with decorative patterns.

In this way, looking back from the front of the water lantern body, the patterns on the translucent panel allows the patterns to keep flickering using the light source of the light-emitting element at the bottom, which makes the patterns having the visually enlarged effects. Accompanying with the emitting of the light-emitting element at the bottom of the holder, the water lantern has the brilliant effects.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
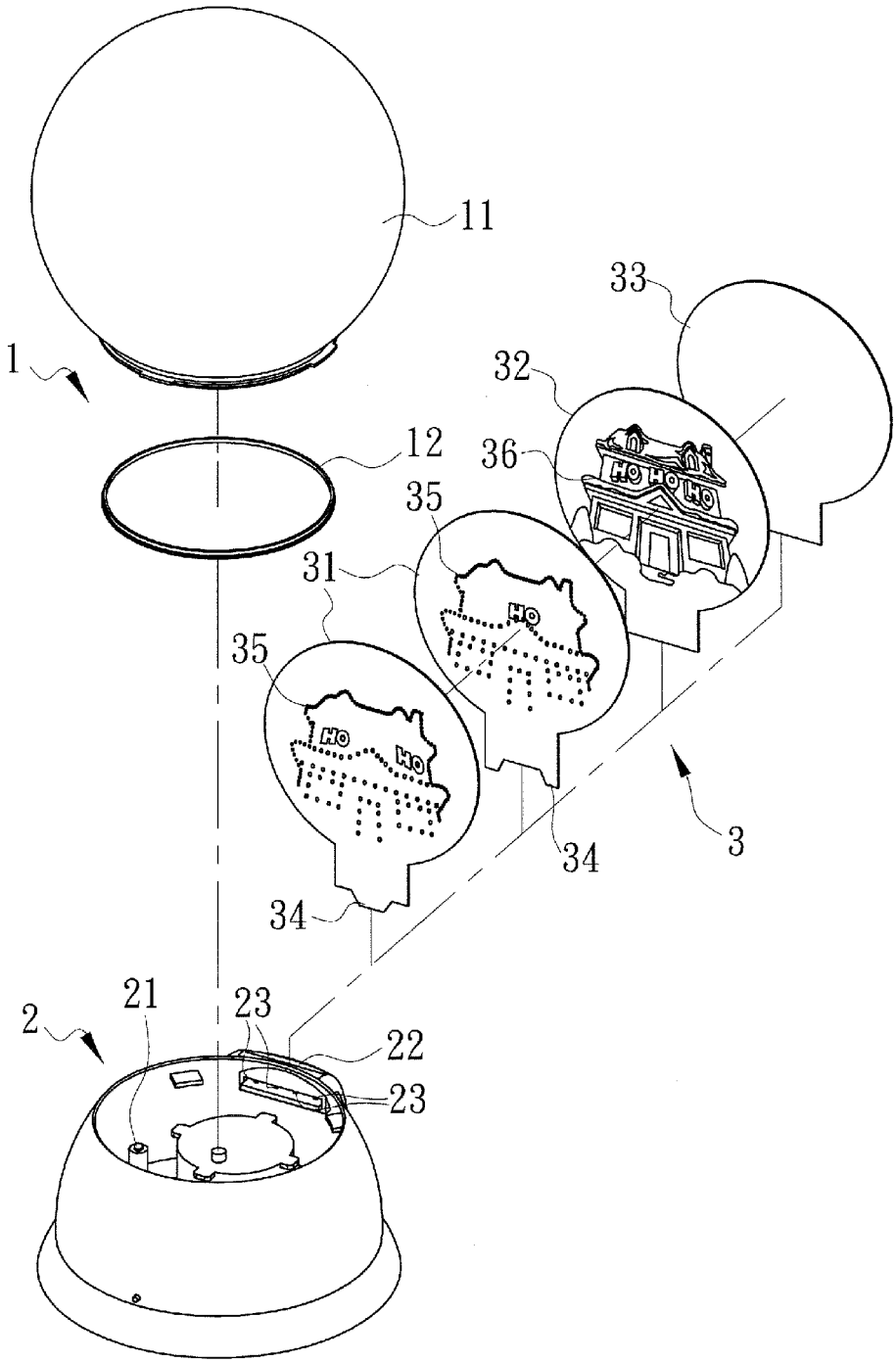
FIG. 1 is a three dimensional exploded view showing the present invention.
Figure 2:
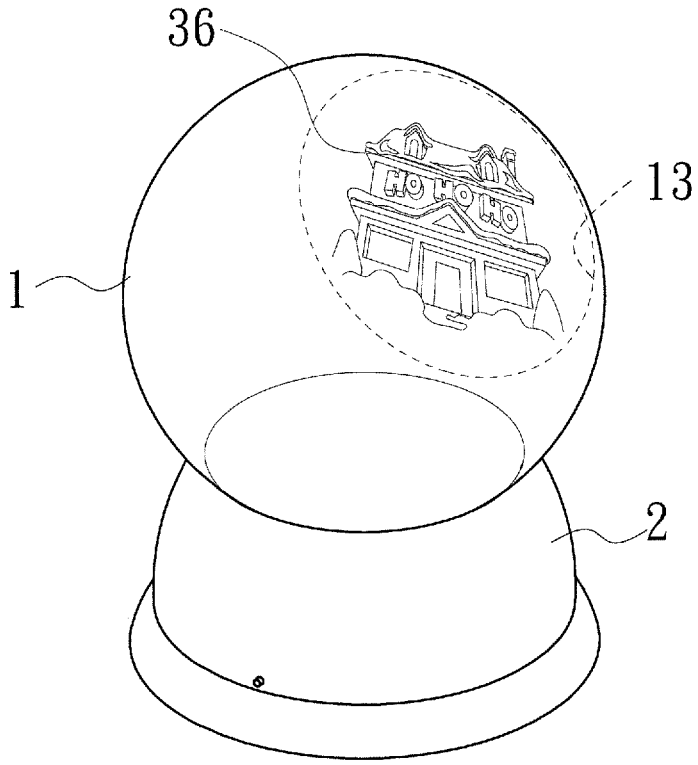
FIG. 2 is a three dimensional diagram showing the present invention.
Figure 3:
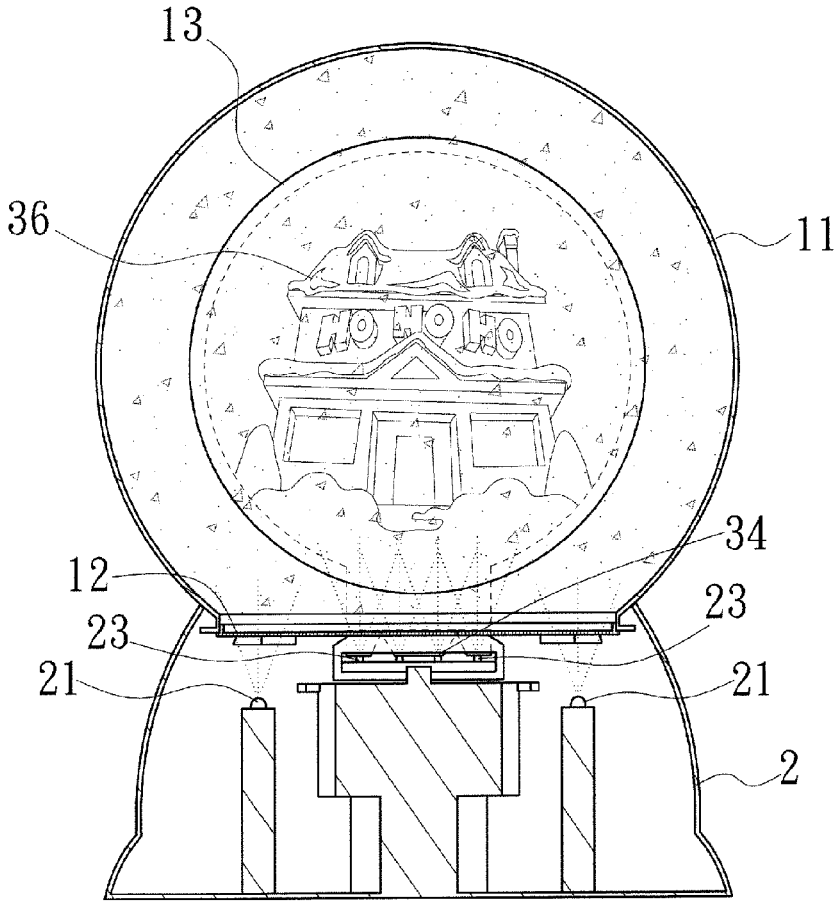
FIG. 3 is a plane sectional view showing the present invention.

Firstly, referring to FIGS. 1-3, which show the three dimensional exploded view, the exterior, and the sectional view of the present invention. The water lantern with flashing light mainly comprises a water lantern body 1, a holder 2, and a graphics card unit 3. The water lantern body 1 is provided above the holder 2. The graphics card unit 3 is provided at the back of the water lantern body 1 and fixed on the holder.

The water lantern body 1 is composed of a hollow casing 11 and a translucent bottom cap 12, which is filled with liquidity liquid with slightly thick status inside and brightness chips or bright powders. The water lantern body 1 comprises a plane portion 13 backward. The water lantern body 1 can be any 3D shape. In the present embodiment, sphere is taken as an example, but not limited.

The holder 2 comprises an opening upward. The opening is correspondingly connected with the water lantern body 1. Two light-emitting elements 21 with an interval are provided inside the holder 2 and corresponding to the bottom cap 12 of the water lantern body 1. The holder 2 is provided with a slot 22 backward corresponding to the plane portion 13. The bottom of the slot 22 is provided with multiple flashing light-emitting elements 23.

The graphics card unit 3 is inserted in the slot 22 of the holder 2. Corresponding to the plane portion 13 of the water lantern body 1 from front to back, it comprises sequentially a translucent panel 31, a graphics card 32, and a backplane 33. The translucent panel 31 is transparent, and the bottom of which extends a protrusion 34. The protrusion 34 is connected with the light-emitting element 23, which is used to guide the light to the entire translucent panel 31. The translucent panel 31 is provided with decorative patterns 35. The decorative patterns 35 can be drawn using fluorescents. In the present embodiment, the decorative patterns 35 are points along the pattern 36 contour of the pattern card 33. The pattern 36 of the pattern card 33 can be buildings, occasional things, people, etc. The backplane 33 is not transparent, which is use to prevent the light source scattering outward and allows the light source to be focused on the translucent panel 31.

Wherein, the protrusions 34 of two translucent panels 31 are staggered. The protrusions 34 contacts with each light-emitting elements 23 respectively. And the partial decorative patterns 35 of the translucent panels 31 are staggered.

By using the flashing light source from the light-emitting elements 23 at the bottom, the patterns 35 of two translucent panels 31 show blinking effect. When looking back from the front of the water lantern body 1, the patterns 35 show the visually enlarged effects. Accompanying with the emitting of the light-emitting element 21 at the bottom of the holder 2, the water lantern has the brilliant effects.

Figure 7:
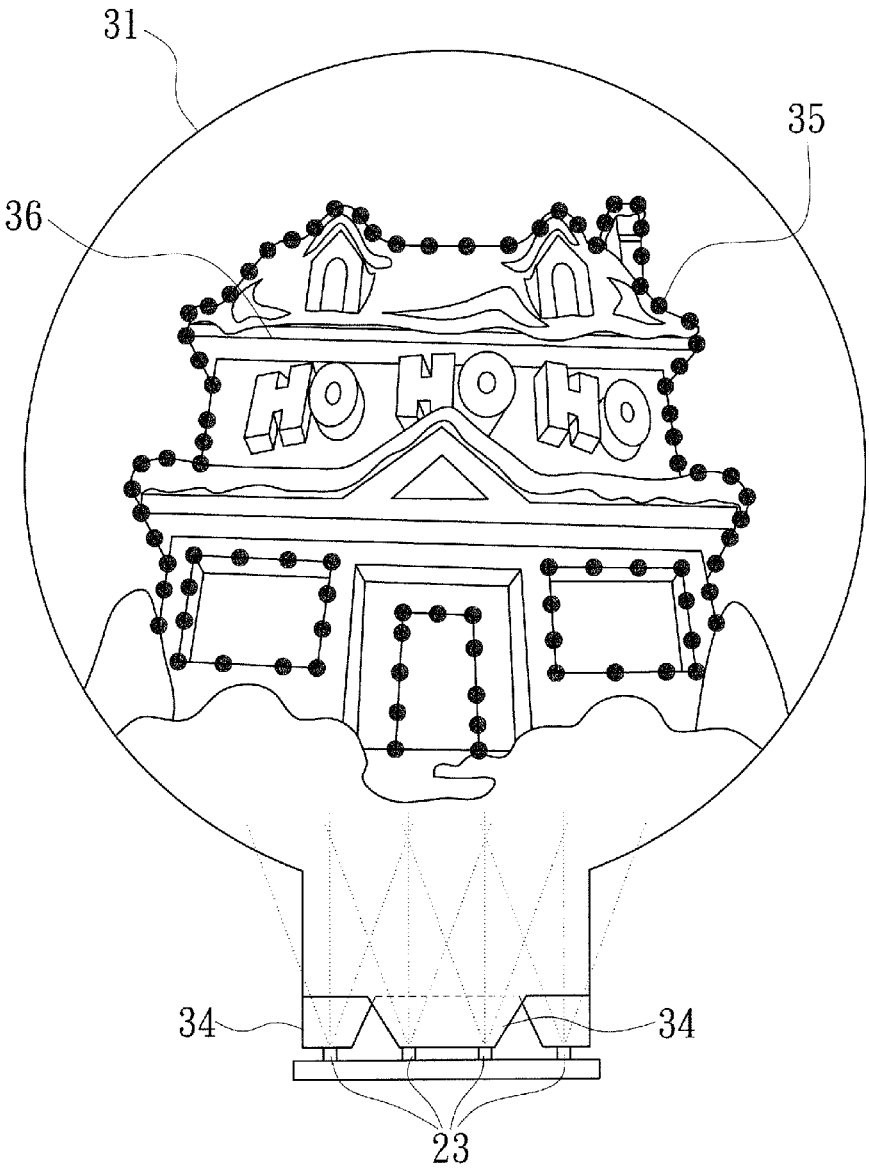
FIG. 7 is a partially enlarged schematic diagram showing the present invention.

As mentioned above, the protrusions 34 extended from the bottom of the two translucent panels 31 contact with the light-emitting elements 23 directly. The light source route of the light-emitting elements 23 is direct. Therefore, the periphery of the translucent panels 31 is luminous. The patterns 35 drawn using fluorescents can reveal bright color due to the light source emitting (as shown in FIG. 7. Moreover, the present invention controls the flashing sequence and time of the light-emitting elements 23, so that the staggered patterns 35 of the translucent panels 31 show such dynamic effects.

Figure 4:
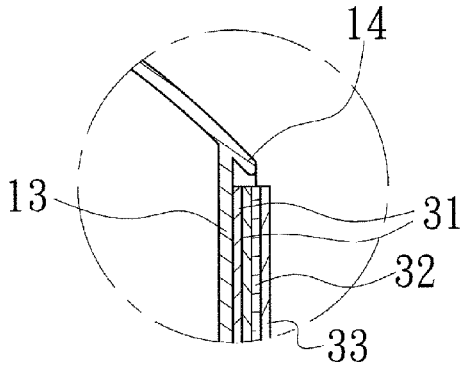
FIG. 4 is a schematic diagram of swing of the present invention.
Figure 4:
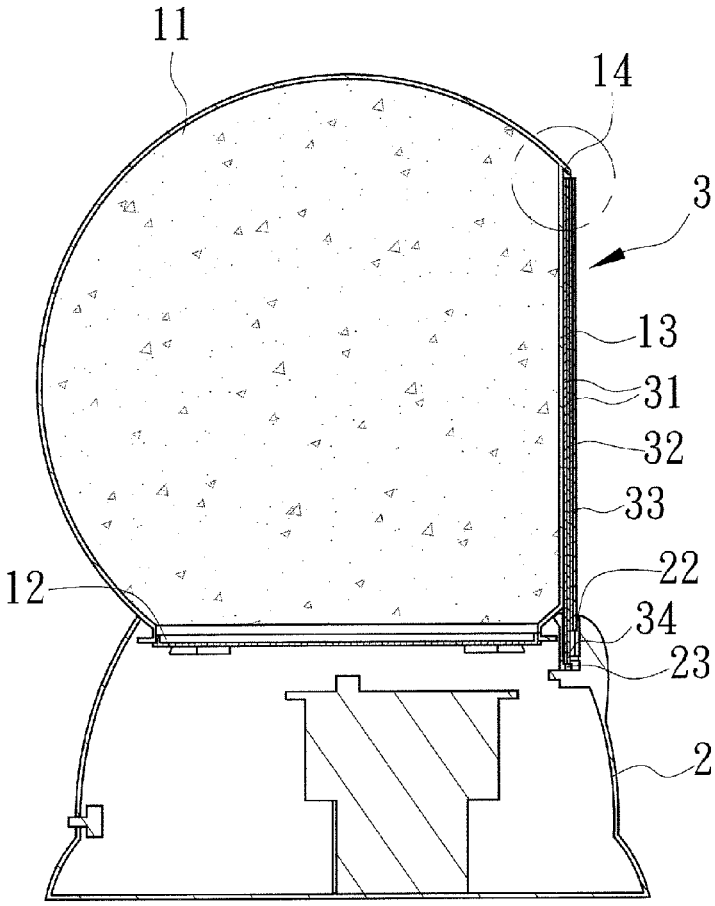

Wherein, as shown in FIG. 4, in order to allow the graphics card unit 3 to be firmly inserted in the slot 22, the periphery of the plane portion 13 of the water lantern body 1 extends a limiting portion 14, which frame encloses the graphics card unit 3.

Figure 5:
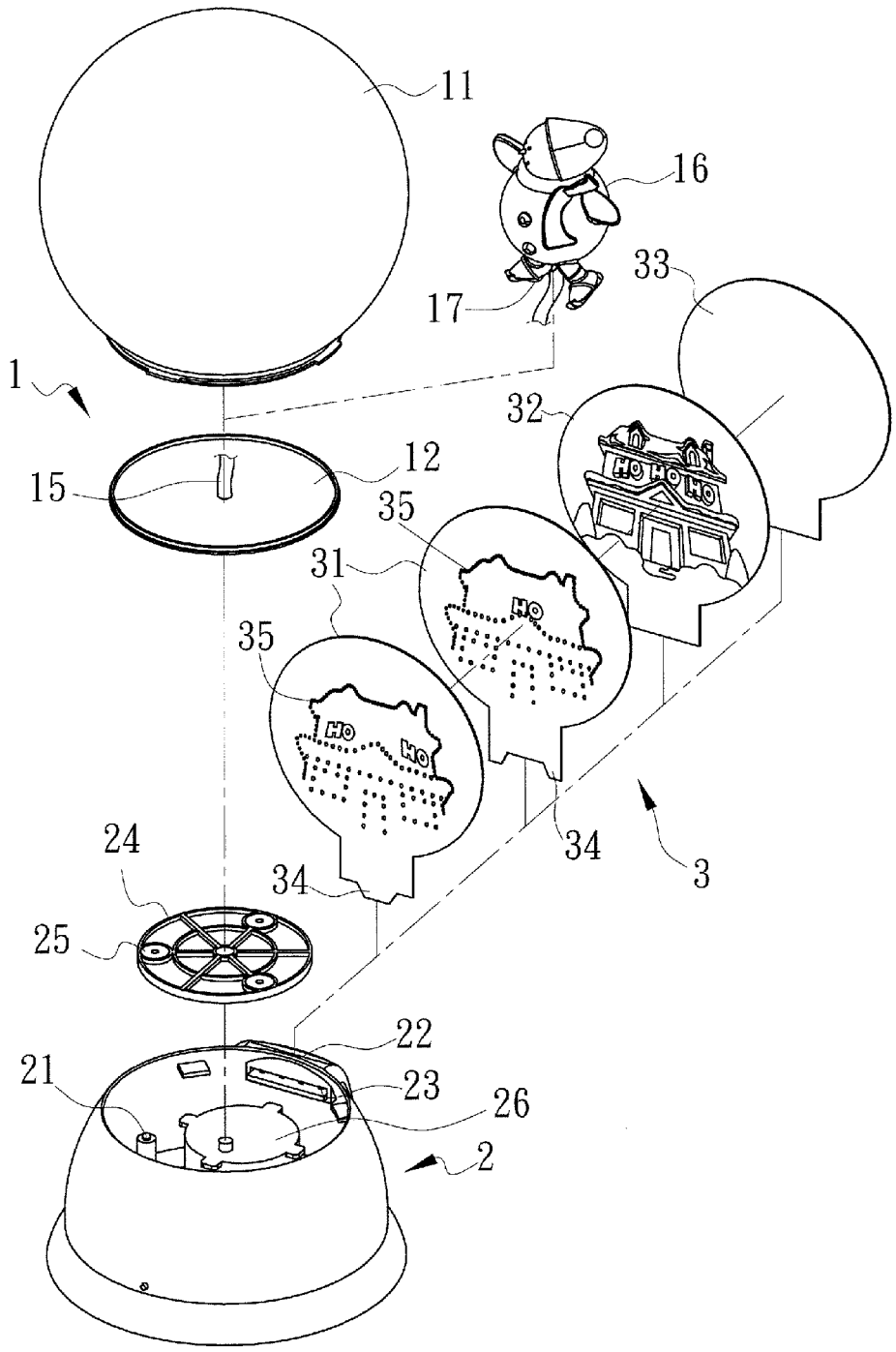
FIG. 5 is a three dimensional exploded view showing the embodiment according to the present invention.
Figure 6:
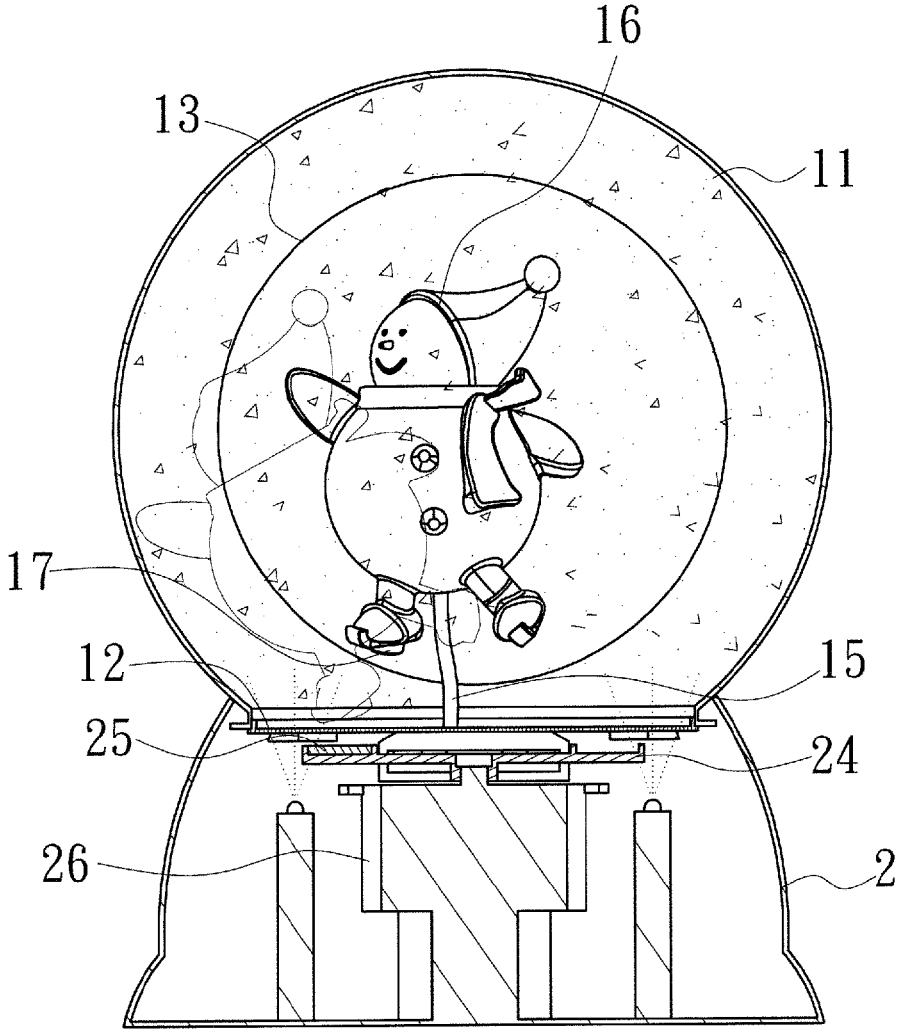
FIG. 6 is a sectional schematic diagram of swing of the present invention.

As shown in FIGS. 5 to 6, they show the three dimensional exploded view, the exterior, and the sectional view of the other embodiment according to the present invention. The bottom cap 12 of the water lantern body 1 is connected to a flexible line body 15. One end of the flexible line body 15 is connected to a three-dimensional swing element 16. The bottom of the three-dimensional swing element 16 is provided with a magnetic element 17. When the inside of the water lantern body 1 is filled with the liquid, the three-dimensional swing element 16 forms vacant shaking visual effects by carrying the liquid.

The holder 2 is provided with a translucent magnetic plate 24 corresponding to the magnetic element 17. The translucent magnetic plate 24 is provided with multiple magnetic media 25 with intervals. The magnetic plate 24 is driven to rotate by a kinetic element 26. In this way, when translucent magnetic plate 24 is rotating, the magnetic media 25 correspondingly are absorb to the magnetic element 17 of the swing element 16, the swing element 16 will swing left and right due to the adsorption of the magnetic property.

As mentioned above, the magnetic element 17 and the magnetic media 25 are better to be strong force magnets, which can adsorb each other by providing the corresponding position, and then the present invention can swing.

In addition, the power drive of the light-emitting elements 21, 23 and the kinetic element 26 are controlled by a switch (not shown). The power source can be correspondingly assembly battery, AC or DC power. The power source can be any kinds and not focused in the patent applications of the present invention, so it is not described in detail.

The light-emitting elements 21, 23 are light emitting diodes and are correspondingly provided at the bottom of the translucent water lantern body 1 and the translucent panel 31, which can change in a variety of light color, so that the water lantern body 1 and the graphics card unit 3 have different visual views, which achieves the effects of various visual changes or interesting development.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A water lantern with flashing light, comprising:

a water lantern body, which is a translucent casing filled with liquidity liquid inside, and the water lantern body comprising a plane portion backward;

a holder, which comprises a opening upward, and the opening correspondingly connected with the water lantern body, at least one light-emitting element provided inside the holder and corresponding to the bottom of the water lantern body, and the holder provided with a slot backward, the bottom of the slot provided with at least one flashing light-emitting element; and a graphics card unit, which is inserted in the slot of the holder, and corresponding to the plane portion of the water lantern body from front to back comprising sequentially a translucent panel, a graphics card, and a backplane, the bottom of the translucent panel extending a protrusion used to obtain the light source from the light-emitting element, and the translucent panel provided with decorative patterns.

2. The water lantern with flashing light according to claim 1, wherein the water lantern body is provided with a three-dimensional swing element fixed by a flexible line body, the bottom of the swing element is provided with a magnetic element; the holder is provided with a translucent magnetic plate corresponding to the magnetic element, the magnetic plate is driven to rotate by a kinetic element.

3. The water lantern with flashing light according to claim 1, wherein the periphery of the plane portion extends a limiting portion, which frame encloses the graphics card unit.

4. The water lantern with flashing light according to claim 1, wherein the light-emitting element is a light-emitting diode.

* * * * *